US005256317A

United States Patent [19]

Lauton

[11] Patent Number: 5,256,317

[45] Date of Patent: Oct. 26, 1993

[54] COMPOSITIONS FOR THE TREATMENT OF LEATHER AND FURS

[75] Inventor: Alain Lauton, Saint-Louis, France

[73] Assignee: Ciba-Geigy Corporation, Ardsley, N.Y.

[21] Appl. No.: 908,646

[22] Filed: Jul. 2, 1992

Related U.S. Application Data

[63] Continuation of Ser. No. 612,749, Nov. 13, 1990, abandoned.

[30] Foreign Application Priority Data

Nov. 13, 1989 [CH] Switzerland ..... 4070/89

[51] Int. Cl.[5] ..... C14C 9/00; C14C 3/20

[52] U.S. Cl. ..... 252/8.57; 8/94.15; 8/94.18; 8/94.25; 8/94.27; 8/94.28; 8/94.29; 8/94.33

[58] Field of Search ..... 252/8.57; 8/94.15, 94.18, 8/94.25, 94.28, 94.29, 94.33, 94.27

[56] References Cited

U.S. PATENT DOCUMENTS 4,830,632 5/1989 Lauton ..... 8/94.33

FOREIGN PATENT DOCUMENTS 0077495 4/1983 European Pat. Off. .
0245205 11/1987 European Pat. Off. .
2463810 2/1981 France .

OTHER PUBLICATIONS

Encyclopedia of Chemical Technology (Third Edition) vol. 20, Resins, Water-Soluble-pp. 216-219, Kirk-Othmer (1982).
Methoden Der Organischen Chemie, Band XIV/2, Eugen Mueller, pp. 705-711 (1963).
Ullmanns Encyklopadie der technischen Chemie, Band 16, Lagerwerkstoff bis Milch, p. 140 (1965).
Methoden Der Organischen Chemie, Eugen Müller, Band XIV/2, pp. 631-633 (1963).
Methoden Der Organischen Chemie, Eugen Müller, Band XIV/1, pp. 1010-1080 (1961).
Chemical Abstracts, vol. 96: 8482m p. 8491 (1982) Derwent Abstract-36750 D/21 (1979).

*Primary Examiner*—José G. Dees
*Assistant Examiner*—B. Frazier
*Attorney, Agent, or Firm*—Kevin T. Mansfield; Edward McC.Roberts

[57] ABSTRACT

A composition for the treatment of leather and furs, containing (A) an anionic aromatic syntan and (B) a polymer and/or copolymer of an unsaturated $C_3$-$C_5$-mono- or dicarboxylic acid and/or hydroxy compounds thereof, a process for the production of wet-white leather and furs and the use of the composition for the said production are described.

10 Claims, No Drawings

COMPOSITIONS FOR THE TREATMENT OF LEATHER AND FURS

This application is a continuation, of application Ser. No. 07/612,749, filed Nov. 13, 1990, now abandoned.

The present invention relates to a composition for the treatment of leather and furs, a process for the treatment of these materials and the use of the compositions for the production of wet-white leather and furs.

In the production of leather, large amounts of waste leather originating from cutting the wet-blue leather are obtained after chrome tanning. This wet-blue waste is rich in chromium salts, elimination of which presents a major problem. The production of wet-white leather is therefore constantly gaining in importance. Aluminium salts, the majority of which still have to be removed by means of an acid treatment before the chrome tanning, are used in the production of these leathers.

Compositions have now been found with which this acid treatment can be avoided.

The composition according to the invention contains (A) an anionic aromatic syntan and (B) a polymer and/or copolymer of an unsaturated $C_3$–$C_5$mono- or dicarboxylic acid and/or hydroxy compounds thereof.

Anionic aromatic syntans are the condensation products of sulfonated precursors with formaldehyde or formaldehyde and urea and the non-condensed sulfonated precursors, for example (I) formaldehyde condensation products of 4,4'-dihydroxydiphenyl sulfones with (hydroxy)arylsulfonic acids, (II) the reaction product of phenol and a sulfonating agent, the molar ratio of (phenol):($SO_3$) being (1):(1.1–2.2), (III) condensation products of 4,4'-dihydroxydiphenyl sulfone and sulfonated 4,4'-dihydroxydiphenyl sulfone with formaldehyde or formaldehyde and urea and (IV) formaldehyde condensation products from diaryl ether-sulfonic acid and 4,4'-dihydroxydiphenyl sulfone.

The condensation products of types (I), (III) and (IV) are known, for example, from Ullmanns Enzyklopädie der technischen Chemie (Ullmann's Encyclopaedia of Industrial Chemistry) volume 16, (4), 140 (1979), and can be prepared by the processes described in the references quoted therein. The preparation can also be carried out under an inert gas, such as nitrogen, helium or carbon dioxide.

The reaction product of type (II) and its preparation are known from EP-A-0,245,205.

Preferred anionic aromatic syntans as component (A) are those of groups (I) and (IV), (hydroxy)-naphthalene- and xylene sulfonic acid (as an industrial mixture) being preferred as the (hydroxy)arylsulfonic acid and ditolyl ether being preferred as the diaryl ether-sulfonic acid.

Component (B) includes those polymers and copolymers of (meth)acrylic acid, maleic acid, itaconic acid and/or hydroxy compounds thereof which have a molecular weight of 1000 to 30,000, in particular 2000 to 15,000. These polymer compounds can be prepared in a manner which is known per se (compare, for example, E. Müller, Houben-Weyl, Methoden der organischen Chemie (Methods of Organic Chemistry), volume 14/I, 1961, 1010–1080 and volume 14/II, 1963, 631–633 and 705–713; Kirk-Othmer (3rd) volume 20, 216–219 and FR-A-2,463,810).

The weight ratio of anionic aromatic syntan to component (B) is advantageously 1:0.03 to 2.2, preferably 1:0.05 to 2.0.

The composition according to the invention can additionally contain a saturated mono- or dicarboxylic acid having a total of 1 to 8 C. atoms, such as formic, acetic, propionic, n-butyric, isobutyric, n-valeric, trimethylacetic, caproic, n-heptylic, caprylic, oxalic, malonic, succinic, glutaric, adipic, pimelic and suberic acid. The weight ratio of component (A) to this acid [component (C)] is 1:0 to 0.08, preferably 1:0 to 0.05.

The composition according to the invention can also contain as an optional component (D) a sequestering agent, such as the tetrasodium salt of ethylenediaminetetraacetic acid and neutral or acid sodium pyrophosphate, in a weight ratio of component (A) to component (D) of 1:0 to 0.08, preferably 1:0 to 0.05. The optional component (D) acts as a complexing agent and is preferably also used in the composition in the case of an iron-free treatment composition if the iron content of the oleum used for the preparation of component (A) is relatively high.

The composition according to the invention can be used for pretanning leather or for tanning furs (hides). The invention thus furthermore relates to a process for the production of wet-white leather and furs.

The process for the production of wet-white leather and furs comprises treating these materials with a composition according to the invention, after pickling in the presence of a water-soluble salt of chromium, aluminium, iron or zirconium or a mixture thereof.

The salts which can be used are ready-to-use tanning salts and are described in the relevant technical literature. Examples of such salts are basic chromium(III) chloride or sulfate, a chrome alum, non-basic or basic aluminium chloride or sulfate, an alum, iron(III) chloride or sulfate, zirconium oxychloride and zirconium sulfate. Mixtures of the chromium and aluminium salts mentioned can also be readily used. Preferred compounds are, however, $[CrCl_2(OH_2)_4]Cl.2H_2O$, $[Cr(OH_2)_6]Cl_3$, $Cr(OH)SO_4$, $Cr_2(OH)_4SO_4$, $KCr(SO_4)_2.12H_2O$, $AlCl_3.6H_2O$, $Al_2(SO_4)_3.16H_2O$, $Al_2(OH)_4SO_4$, $Al(OH)_2Cl$, $Al(OH)Cl_2$, $KAl(SO_4)_2.12H_2O$, $Fe_2(SO_4)_3.9H_2O$, $Zr(OH)_2SO_4$, $ZrOCl_2.8H_2O$ and $Zr(SO_4)_2.4H_2O$.

The aluminium salts and in particular aluminium sulfate $Al_2(SO_4)_3.16H_2O$ are of prime interest. The weight ratio of composition according to the invention (as dry substance) to aluminium salt (as $Al_2O_3$) is 1:0.08 to 1.5, preferably 1:0.1 to 1.0.

Compositions according to the invention which contain none of the salts mentioned can also be used as retanning agents with good plumping and softening properties.

The procedure here is in accordance with conventional methods, the pickled pelts or furs (hides) being treated with an aqueous solution containing the composition according to the invention and the wet-white material thus obtained then being tanned in the customary manner using vegetable or synthetic tannins or chrome tannins. 100 to 200, preferably 100 to 150, parts by weight of water and 3 to 30 parts by weight of the aqueous composition according to the invention are as a rule employed per 100 parts by weight of pelts or hide. Wet-white materials having a shrinkage temperature of 60° to 75° C., good light-fastness properties and a pale intrinsic colour are obtained.

Since the compositions according to the invention are particularly suitable for the production of wet-white leather and furs, the invention furthermore relates to their use for this purpose.

When preparing the compositions according to the invention, a procedure is in general followed in which an aqueous solution of component (A) is mixed if appropriate with components (C) and (D) and then with component (B).

The aqueous compositions according to the invention preferably contain 64 to 76% by weight of component (A), 18 to 36% by weight of component (B), 0 to 7% by weight of component (C), 0 to 4% by weight of component (D) and water to make up 100% by weight.

The compositions thus obtained are liquid and have a good storage stability. If appropriate, however, they can be dried.

Percentages and parts in the following instructions and examples are by weight.

PREPARATION INSTRUCTIONS

Procedure A 100 parts of the sulfonation mixture, obtained by heating 520 parts of naphthalene and 560 parts of concentrated sulfuric acid at 140° to 160° C. for several hours until water-solubility is achieved, are heated at 105° to 110° C. with 56 parts of a dihydroxydiphenyl sulfone, obtained by heating 540 parts of phenol and 180 parts of 60% oleum at 170° to 180° C. for 3 hours and distilling off the excess phenol, 50 parts of water and 29 parts of formaldehyde (37%) for 1 hour. The resulting product is then rendered weakly acid with ammonia. A water-soluble clear solution having a dry content of 51% is obtained.

Procedure B

The method is as described in Procedure A, but 31 parts of a dihydroxydiphenyl sulfone are employed. A clear water-soluble solution having a dry content of 47% is obtained.

Procedure C 100 parts of the sulfonation mixture obtained by heating 160 parts of xylene mixture and 240 parts of concentrated sulfuric acid at 130° to 135° C. for several hours until water-solubility is achieved are heated at 100° to 105° C. with 40 parts of a dihydroxydiphenyl sulfone, 32 parts of water and 35 parts of formaldehyde (37%) for 3 hours. The resulting product is then rendered weakly acid with ammonia. A water-soluble clear solution having a dry content of 60% is obtained.

PREPARATION EXAMPLES

Example 1

10 parts of glutaric acid, 5 parts of the sodium salt of ethylenediaminetetraacetic acid and 100 parts of a 30% aqueous polymethacrylic acid having a molecular weight of 9000 are added to a solution of 200 parts of phenolic tannin prepared according to instructions A. 315 parts of a viscous, pale brown, readily flowing solution which is homogeneous after storage for 3 months, that is to say shows no clouding or flocculation at all, are obtained.

Example 2

9 parts of 85% formic acid and 200 parts of 30% aqueous polymethacrylic acid having a molecular weight of 5000 are added to a solution of 200 parts of the phenolic tannin prepared according to instructions B. 409 parts of a viscous, brown, readily flowing solution, which is homogeneous after storage for 3 months, are obtained.

Example 3

100 parts of a 35% methacrylic acid prepared from a monomer content of 70% of methacrylic acid and 30% of acrylic acid and having a molecular weight of 10,000 are added to a solution of 200 parts of the phenolic tannin prepared according to instructions B. 300 parts of a viscous, brown solution, which is homogeneous after storage for 3 months, are obtained.

Example 4

10 parts of an 85% formic acid and 60 parts of a 50% aqueous polyacrylic acid of molecular weight 5000 are added to a solution of 200 parts of the phenolic tannin prepared according to instructions C. 270 parts of a viscous, brown, readily flowing solution, which is homogeneous after storage for 3 months, are obtained.

Example 5

200 parts of a 30% aqueous solution of the sodium salt of a polymethacrylic acid of molecular weight 9200 are added to 200 parts of a dihydroxydiphenyl sulfone, obtained by heating 540 parts of phenol and 180 parts of 60% oleum at 170° to 180° C. for 3 hours and distilling off the excess phenol. After the resulting product has been dried, 260 parts of a brown powder are obtained.

USE EXAMPLES

Example 1

100 parts of a pickled calf pelt [pH of the liquor 3.5] are treated with 100 parts of water and 6 parts of the composition prepared according to Preparation Example 2 in a rolling drum at 20° C. for 3 to 4 hours. 2 parts of a 65% basic aluminium sulfate solution (22% of $Al_2O_3$) are then also added and the treatment is continued for 6 hours. A wet-white leather which can be stored, sammed and milled is obtained. Its shrinkage temperature is about 70° C. Wet-white leathers produced in the same manner can be retanned, if required, with vegetable and synthetic tannins or with chrome tannins.

Example 2

The procedure is as described in Example 1, but 6 parts of the composition prepared according to Preparation Example 4 are used instead of 6 parts of the composition according to Preparation Example 2. A wet-white leather of good light-fastness properties and a shrinkage temperature of about 70° C. is obtained.

Example 3

100 parts of a pickled wool sheepskin are treated in a liquor consisting of 1000 parts of water, at 20°-35° C. and 5° Bé, and 5 to 10 parts of an electrolyte-stable fat liquoring agent for 1 hour and then treated overnight in the liquor with 20 parts of the composition prepared according to Preparation Example 2 and 2 parts of a 65% basic aluminium sulfate solution (22% of $Al_2O_3$). The pH is then brought to 3.5-3.8 with sodium carbonate. After 2 hours, the material is rinsed, dried and finished in the customary manner. The wool sheepskin treated in this way has a shrinkage temperature of about 65° C., is soft and has a white, natural intrinsic colour.

Example 4

100 parts of a pickled calf pelt (pH of the liquor 3.5) are treated at 30° C. in a rolling drum with 100 parts of water, 6 parts of 85% formic acid and 7 parts of the composition prepared according to Preparation Example 5 for 6 hours. A wet-white leather which can be stored, sammed and milled is obtained. Its shrinkage temperature is about 69° C.

What is claimed is:

1. A composition for the treatment of pickled pelts or furs which is essentially free of an aluminium salt and essentially consisting of (A) a formaldehyde condensation product of a 4,4'-dihydroxydiphenyl sulfone with a (hydroxy)arylsulfonic acid or a formaldehyde condensation product of a diaryl ether-sulfonic acid and 4,4'-dihydroxydiphenylsulfone, and (B) a polymer and/or a copolymer of an unsaturated $C_3$–$C_5$mono- or dicarboxylic acid and/or a hydroxy derivative thereof, wherein components (A) and (B) are in a weight ratio of (A):(B) of 1:0.03 to 2.2.

2. A composition according to claim 1, which contains a component (B) a polymer and/or copolymer of (meth)acrylic acid, maleic acid, itaconic acid and/or a hydroxy compound thereof.

3. A composition according to claim 1, in which component (B) has a molecular weight of 1000 to 30,000.

4. A composition according to claim 1, which additionally contains a mono- or dicarboxylic acid having a total of 1 to 8 C atoms.

5. A composition according to claim 1, which additionally contains a sequestering agent.

6. A composition according to claim 1, in which component (A) is a condensation product of naphthalenesulfonic acid, 4,4'-dihydroxydiphenyl sulfone and formaldehyde.

7. A composition according to claim 1, in which component (A) is a condensation product of a sulfonated industrial xylene mixture, 4,4'-dihydroxydiphenyl sulfone and formaldehyde.

8. A composition according to claim 1, in which component (A) is a condensation product of a sulfonated ditolyl ether, 4,4'-dihydroxydiphenyl sulfone and formaldehyde.

9. A process for the preparation of wet-white leather and furs, which comprises treating these materials with a composition according to claim 1.

10. The wet-white leather and furs produced by the process according to claim 9.

* * * * *